US009246234B2

(12) United States Patent
Rao et al.

(10) Patent No.: US 9,246,234 B2
(45) Date of Patent: Jan. 26, 2016

(54) ANTENNA FOR MULTIPLE FREQUENCY BANDS

(71) Applicant: Northrop Grumman Systems Corporation, Falls Church, VA (US)

(72) Inventors: Sudhakar K. Rao, Rancho Palos Verdes, CA (US); Sebong Chun, Orange, CA (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 248 days.

(21) Appl. No.: 14/034,688

(22) Filed: Sep. 24, 2013

(65) Prior Publication Data

US 2015/0084821 A1 Mar. 26, 2015

(51) Int. Cl.

| | |
|---|---|
| ***H01Q 19/19*** | (2006.01) |
| ***H01Q 1/28*** | (2006.01) |
| ***H01Q 5/55*** | (2015.01) |

(52) U.S. Cl.

CPC ..... *H01Q 19/193* (2013.01); *H01Q 1/28* (2013.01); *H01Q 5/55* (2015.01); *H01Q 19/19* (2013.01)

(58) Field of Classification Search

CPC ..... H01Q 19/10; H01Q 19/102; H01Q 19/12; H01Q 19/13; H01Q 19/134; H01Q 19/18; H01Q 19/19; H01Q 19/193; H01Q 15/16; H01Q 5/55; H01Q 1/12; H01Q 1/1207; H01Q 1/28; H01Q 1/288; H01Q 15/14

USPC ..... 343/781 CA, 781 R, 781 P, 834, 837, 343/840, 912, 713, 717, 878

See application file for complete search history.

(56) References Cited

U.S. PATENT DOCUMENTS

| | | | | |
|---|---|---|---|---|
| 3,241,147 | A | 3/1966 | Morgan | |
| 4,672,387 | A * | 6/1987 | Waddoup et al. | 343/781 P |

(Continued)

FOREIGN PATENT DOCUMENTS

| | | |
|---|---|---|
| CA | 1191944 | 8/1985 |
| CA | 2125602 | 2/1995 |

(Continued)

OTHER PUBLICATIONS

Avago Technologies, "AMMC-5040 20-45GHz GaAs Amplifier", Aug. 23, 2010, Avago Technologies, p. 1.*

(Continued)

*Primary Examiner* — Sue A Purvis
*Assistant Examiner* — Patrick Holecek
(74) *Attorney, Agent, or Firm* — Patti & Malvone Law Group, LLC

(57) ABSTRACT

An exemplary embodiment of an antenna in accordance with the present invention utilizes a sub-reflector and a main reflector with each of them having its own focal-ring type geometry. The antenna cooperates with a signal transmission feed disposed at the center of the antenna axis between the first and main reflectors to emit radio signals towards the sub-reflector. The sub-reflector reflects radio waves towards a main reflector which in turn reflects the radio waves to form the beam pattern emitted by the antenna. The reflecting surface of the sub-reflector is formed by a portion of an axially-displaced ellipse rotated about the antenna axis. The reflecting surface of the main reflector is defined by a section of a parabola rotated about the antenna axis to form a reflecting surface that concavely slopes away from the antenna axis. An embodiment of the antenna provides a wide coverage conical beam with selectable beam peaks that operate over a 2.25:1 frequency band range and provides substantially iso-flux beam density.

19 Claims, 5 Drawing Sheets

(56) References Cited

U.S. PATENT DOCUMENTS

| | | | |
|---|---|---|---|
| 6,031,502 | A | 2/2000 | Ramanujam et al. |
| 6,043,788 | A | 3/2000 | Seavey |
| 6,429,823 | B1 | 8/2002 | Bains et al. |
| 6,937,201 | B2 | 8/2005 | Gothard et al. |
| 2007/0200781 | A1 | 8/2007 | Ahn et al. |

FOREIGN PATENT DOCUMENTS

| | | |
|---|---|---|
| EP | 1128468 | 8/2001 |
| EP | 2485328 A1 * | 8/2012 |

OTHER PUBLICATIONS

Fernando Jose da Silva Moreira, "Classical Axis-Displaced Dual-Reflector Antennas for Omnidirectional Coverage", Sep. 2005, IEEE, vol. 53, pp. 2799-2807.*

Karim A. Fouad, "Using LEO-GEO Cross-Link to Enhance LEO Satellite Communication Coverage Area", Aug 12, 2008, IEEE, pp. 882-887.*

Rao, S. et al; Advanced antenna technologies for satellite communication payloads; Antennas and Propagation, 2006; EuCAP 2006; First European Conference on, pp. 1-6; Nov. 6-10, 2006.

Han, Sung-Min et al; Simulation and electrical design of the offset dual reflector antenna with conical beam scanning; Antennas and Propagation Society International Symposium, 2007 IEEE; pp. 845-848, Jun. 9-15, 2007.

Theunissen; W.H. et al; Reconfigurable contour beam-reflector antenna synthesis using a mechanical finite-element description of the adjustable surface; Antennas and Propagation, IEEE Transactions on , vol. 49, No. 2, pp. 272-279, Feb. 2001.

Viskum, H. et al.; A dual offset shaped reflector with a tilted elliptical main reflector; Antennas and Propagation Society International Symposium, 1993. AP-S. Digest , pp. 776-779, vol. 2, Jun. 28-Jul. 2, 1993.

Pereira, L. C. P. et al; Radiation pattern control by subreflector shaping; Antennas and Propagation Society International Symposium, 2002. IEEE , vol. 1, pp. 674-677 vol. 1, 2002.

Ramanujam, P. et al; Different methods of PO analysis in a dual reflector antenna with a shaped main reflector; Antennas and Propagation Society International Symposium, 1996; AP-S. Digest , vol. 1, pp. 230-233 vol. 1, Jul. 21-26, 1996.

Gothard, G. et al; Design of a Simultaneous Center-Fed X/Ka-Band SATCOM Reflector Antenna with Replacable C-Band Option; Military Communications Conference, 2007. MILCOM 2007. IEEE , pp. 1-7, Oct. 29-31, 2007

Vesnik, M.V.; On the Possibility of the Application of Axially Displaced Ellipse Antenna Elements for Construction of a Compact Multibeam Antenna System; Antennas and Propagation Magazine, IEEE , vol. 53, No. 2, pp. 125-129; Apr. 2011.

Cavalier, M.; Marine stabilized multiband satellite terminal; MILCOM 2002. Proceedings , vol. 1, pp. 165-167 vol. 1, Oct. 7-10, 2002

Zang, S.R. et al; Design of omnidirectional dual reflector antenna: Case of the main reflector with circular generatrix; Microwave & Optoelectronics Conference (IMOC), 2011 SBMO/IEEE MTT-S International, pp. 416-419; Oct. 29, 2011-Nov. 1, 2011.

* cited by examiner

ANTENNA FOR MULTIPLE FREQUENCY BANDS

BACKGROUND

This invention relates to antennas suited for use by aircraft or satellites for communications where a wide coverage conical beam is desired without the use of movable elements or electronic beam steering.

A variety of antennas have been designed for use at gigahertz frequencies. One such antenna design has a short backfire cup-dipole driven element disposed a distance away from a center vertex of a concave cone shaped reflector. This antenna design utilizes a balun to match the driven element with a coaxial feed. The balun may be complicated to manufacture at such frequencies and provides matching characteristics that vary with temperature variations. Such an antenna is not capable of providing dual band operation where the two bands are separated by a substantial frequency difference, e.g. 20 GHz band and 45 GHz. Another antenna design is a conical helix antenna extending perpendicular from a planar reflector that provides limited bandwidth coverage and is likewise not capable of providing such dual band operation.

There exists a need for a single antenna that can provide a wide coverage conical beam and operate over two widely separated frequency bands.

SUMMARY

It is an object of the present invention to satisfy this need.

An exemplary embodiment of an antenna in accordance with the present invention utilizes a sub-reflector and a main reflector. The antenna cooperates with a signal transmission feed disposed at the center of the antenna axis between the first and main reflectors to emit radio signals towards the sub-reflector. The sub-reflector reflects radio waves towards a main reflector which in turn reflects the radio waves to form the beam pattern emitted by the antenna. The reflecting surface of the sub-reflector is formed by a portion of an axially-displaced ellipse rotated about the antenna axis. The reflecting surface of the main reflector is defined by a section of a parabola rotated about the antenna axis to form a reflecting surface that concavely slopes away from the antenna axis. An embodiment of the antenna provides a wide coverage conical beam with selectable beam peaks that operate over more than 2.25:1 bandwidth ratio (defined as the ratio of the highest frequency of the high band to the lowest frequency of the low band) and provides substantially iso-flux beam density on the ground. The beam peak locations for the conically shaped beam can be extended up to 90 degrees from the antenna boresight axis to enable wide area coverage surveillance for the aircraft.

DESCRIPTION OF THE DRAWINGS

Features of exemplary implementations of the invention will become apparent from the description, the claims, and the accompanying drawings in which:

DETAILED DESCRIPTION

The exemplary antenna design is explained in terms of transmit mode, however reciprocity applies so the antenna also functions to receive signals. Signals being received by the antenna are carried by radio waves impinging on the antenna as opposed to signals being radiated from the antenna. Even though the antenna itself is capable of both transmitting and receiving signals, the feed system for the antenna must also be capable of transmitting and receiving signals in corresponding frequency bands in order to deliver the signals to the antenna to be radiated and to couple signals received from the antenna to detectors for the extraction of the encoded information.

Figure 1:
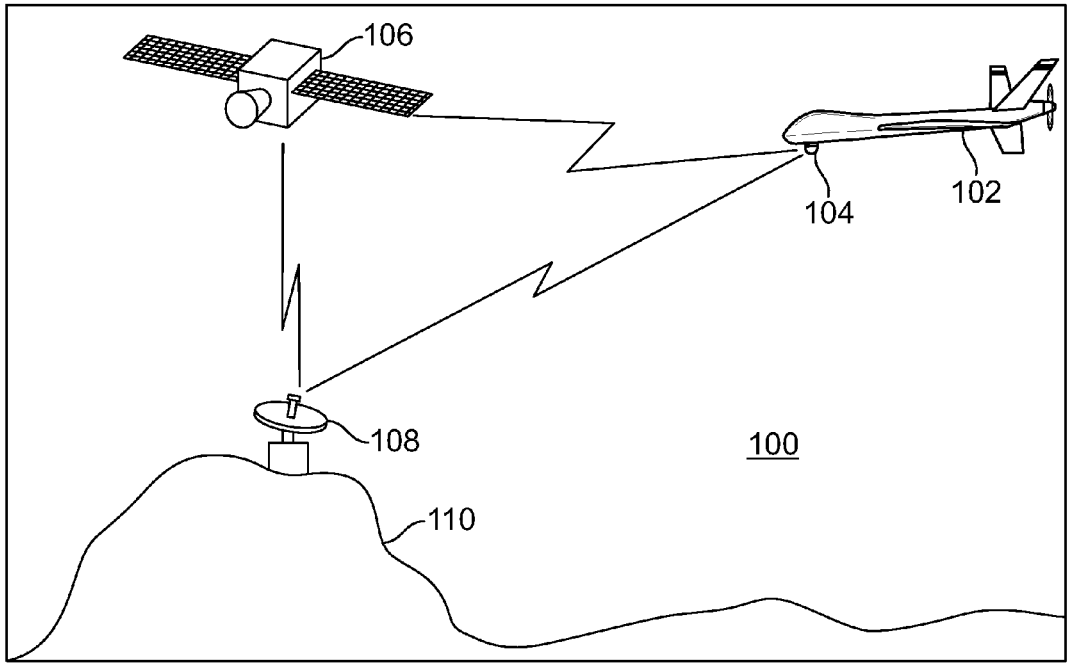
FIG. 1 illustrates an exemplary communications environment in which an antenna in accordance with an embodiment of the present invention is mounted on an aircraft for communications with ground terminals and geo-stationary satellites.

FIG. 1 shows an exemplary communications environment 100 in which an in-flight aircraft 102 has mounted thereto an antenna 104 in accordance with the present invention that produces a wide coverage conical beam. As used herein, a wide coverage conical beam means a conical beam with a circular beam peak being more than 45° relative to the antenna axis. The aircraft 102 in one example may be an unmanned aircraft which includes a receiver that recovers command and control information carried by radio signals received by antenna 104. The aircraft will also include a transmitter that encodes information and data generated by the aircraft's sensors and circuitry on radio signals transmitted from antenna 104. A communication satellite 106 contains a transceiver with complementary frequencies suited for receiving communications from antenna 104 and transmitting information to antenna 104. The communication satellite 106 also receives and transmits signals with a communication station 108 located on the earth 110 which likewise contains an appropriate transceiver enabling communications with the satellite 106. This communication system enables a person located on the surface of the earth to send command and control information by station 108 and satellite 106 to the aircraft 102. Likewise such a person is able to receive information and data from the aircraft 102 as relayed through the satellite 106 and station 108. Alternatively, the station 108 may communicate directly with the aircraft 102, e.g. during takeoff and landing of the aircraft depending on where the takeoffs and landings are located. Although the exemplary antenna is described in terms of being disposed on an unmanned aircraft, it will be understood that embodiments of the antenna may be useful for a variety of applications, e.g. manned aircraft, satellites, etc.

Figure 2:
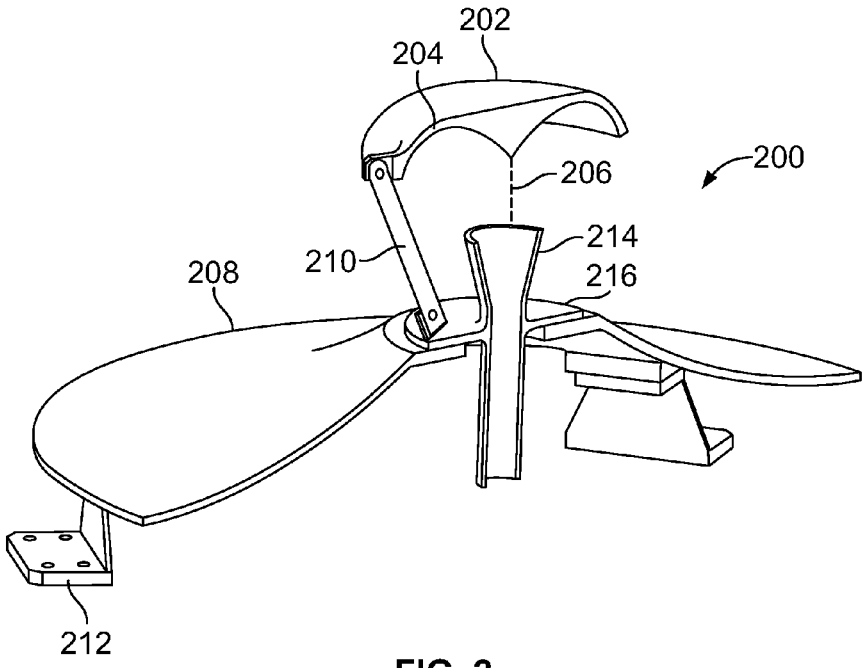
FIG. 2 is a perspective view of a cross-section of an antenna in accordance with an embodiment of the present invention.

FIG. 2 illustrates a cross-section of an antenna 200 in accordance with an embodiment of the present invention. The antenna 200 includes a first reflector 202, also be referred to as a sub-reflector, having a reflecting surface that may be described as a portion of two axially-displaced ellipsoids 204 with each having a major axis that is not parallel to the axis 206 of the antenna. A main reflector 208, which has a reflecting surface that faces the first reflector, may be described as a section of a parabola rotated about the antenna axis. Multiple mounting brackets 210, e.g. three brackets, secure the first reflector 202 to the main reflector 208 so that the first reflector 202 does not move relative to the main reflector 208 during operation of the antenna. Primary mounting brackets 212, e.g. three brackets, secure the main reflector 208, and hence the antenna itself, to the aircraft or device for which the antenna is to support communications. Preferably brackets 212 hold the distal edge of the main reflector 208 a distance away from the surface to which the antenna is mounted, e.g. an aircraft, so that signals radiated at an angle of greater than 90° relative to the antenna axis (with the center of first reflector being 0°) can propagate without striking the surface of the aircraft. A signal transmission feed system 214, e.g. a conical horn, preferably centered about the antenna axis 206 emits signals toward the reflecting surface of the first reflector 202 that are to be transmitted from the antenna and supports the delivery of received signals reflected from the first reflector 202 to appropriate signal processing equipment. Although a feed horn is referred to in the remaining description, any appropriate signal transmission feed system could be utilized. The first and main reflectors are described in more detail below.

Figure 3:
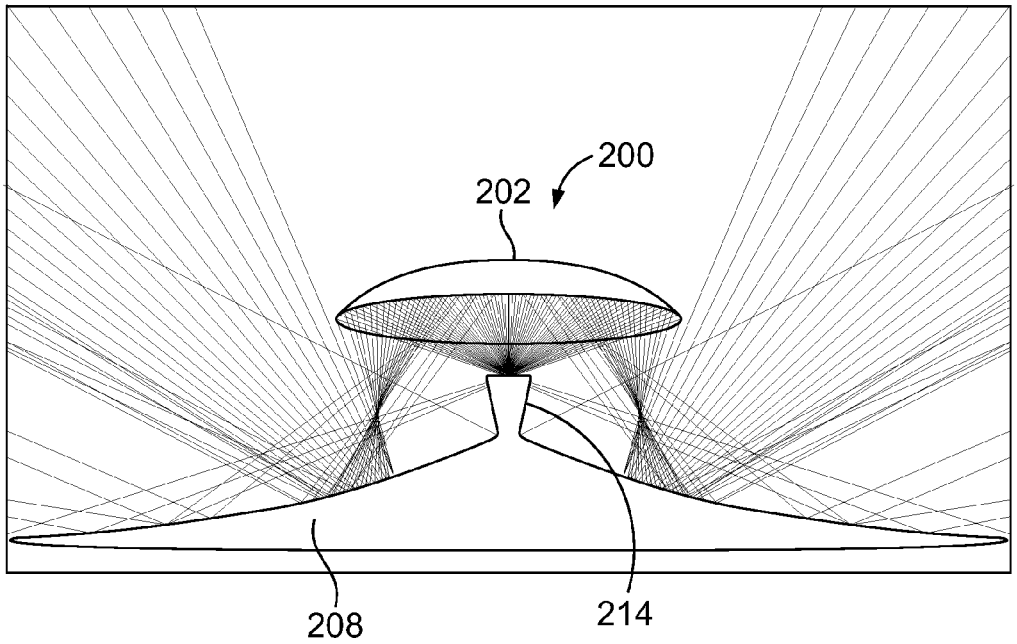
FIG. 3 is a view of an exemplary antenna in accordance with an embodiment of the present invention with representative geometrical optic rays approximating the propagation of radio waves from the feed horn to the free-space via the tandem reflector pair.

FIG. 3 shows exemplary antenna 200 without the mounting brackets with representative visual rays that are intended to approximate the reflection of radio waves. Rays emitted from the signal transmission feed system 214 strike the reflecting ellipsoid surfaces of the first reflector 202 which in turn reflect the rays toward the reflecting surface of the main reflector 208. The rays striking the main reflector 208 are reflected from the antenna to the free-space forming a conically shaped beam pattern. As indicated, this visual ray representation helps in visualizing the basic nature of radio wave reflections, but is only an approximation. FIG. 3 shows no visual rays being emitted near the axis of the antenna. This is achieved in the design by shaping subreflector and main reflector surfaces such that there are no geometrical optic rays in the shadow region of the main reflector being blocked by the sub-reflector and feed to minimimize gain impact due to blockage. The geometrical optic ray depiction does not account for scattering and diffraction caused by the edges of tandem reflector pair that result in some gain near the axis of the antenna but with lower gain than the peak value.

Figure 4:
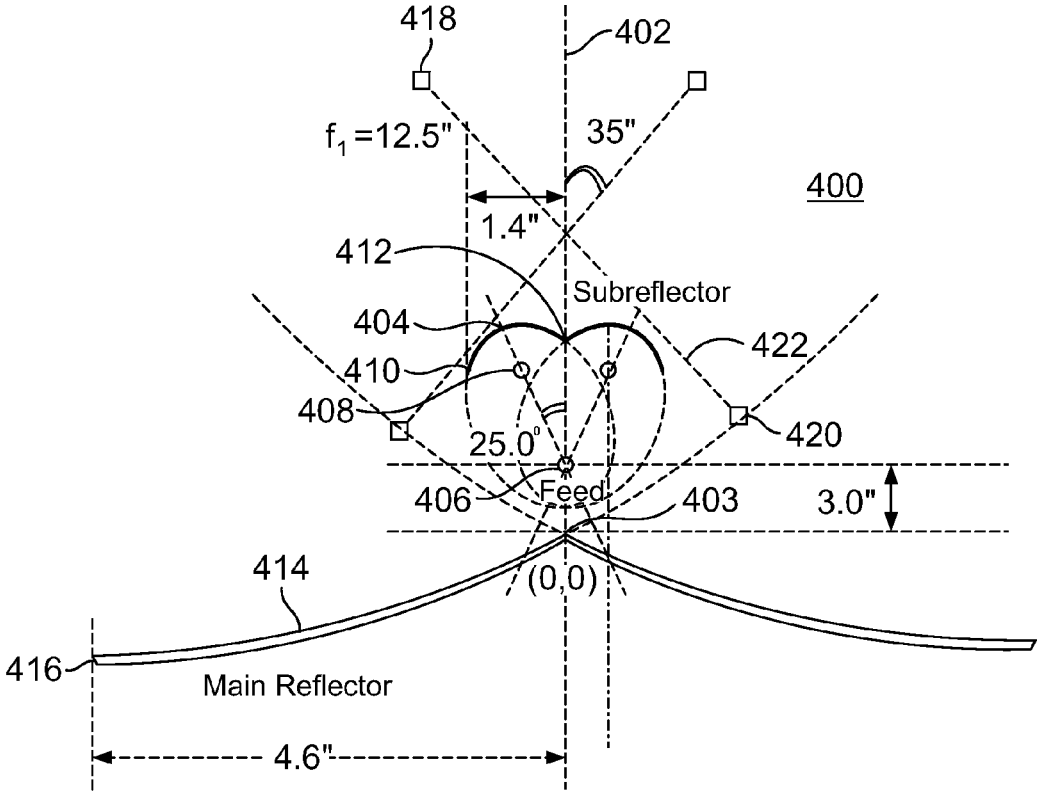
FIG. 4 is a geometric representation of an exemplary antenna in accordance with an embodiment of the present invention with beam peaks at 62.5° relative to the axis of the antenna.

FIG. 4 shows a geometric representation of a cross-section of the exemplary antenna 400 with beam peaks at 62.5° relative to the axis 402 of the antenna. Point 403 represents the origin (0, 0) of an X-Y coordinate system with the y-axis coinciding with the antenna axis 402. The sub-reflector 404 is an ellipsoid formed by a portion of an ellipse that has its major axis displaced, i.e. not parallel, with the y-axis. The portion of the ellipse, which is in a plane that includes the antenna axis 402, is rotated perpendicularly about the y-axis to define the reflecting surface of the sub-reflector 404. A first focal point 406 and a second focal point 408 mathematically specify the ellipse. The ellipsoid may also be thought of as defined by an infinite number of ellipses all having a focal point 406 and the other foci being a circle perpendicular to the y-axis that includes point 408. The first focal point 406 is located on the y-axis +0.3 inches above the origin which is equal with the distal end of the feed horn which is centered on the y-axis. The second focal point 408 is located 0.8 inches from the first focal point with a line connecting the first and second focal points (along the major axis of the ellipse) disposed at an angle of 25.0° from the y-axis using the first focal point and the y-axis references for the angle. This angle is measured to the left of the y-axis. Rotating such an ellipse perpendicularly about the y-axis would produce a "heart-shaped" ellipsoid. However, only a top portion of such ellipsoid as illustrated in FIG. 4 is utilized as sub-reflector 404 and is formed by rotating only a portion of the ellipse about the y-axis. None of the ellipse that would lie to the right of the y-axis, i.e. positive X values, is utilized to form the portion to be rotated. Tracing the top of the ellipse from the y-axis with increasingly negative x-axis values, at X=−1.4 inches the ellipse is truncated so that none of the ellipse with y-axis values below the X=−1.4 inches point is utilized. Thus, the portion of the ellipse from point 410 to point 412 is the portion that is rotated perpendicular about the y-axis to form the reflecting (active) surface of sub-reflector 404. As seen in cross section, it could be described as being a top portion of a heart shape. FIG. 4 shows a mirror image of the above described ellipse on the other side of the y-axis as an aid to visualizing the rotation of the ellipse about the y-axis.

A main reflector 414 is formed by a perpendicular rotation about the y-axis of a portion of a parabola extending from the origin (point 404) to point 416. The parabola, which is within a plane that also includes the y-axis, is defined by a focal point 418, vertex 420 and an axis of symmetry 422. The parabola has a focal length of 12.5 inches between the focal point 418 and the vertex 420. The vertex 420 is disposed such that it would lie on an extension of the arc of the parabola defining the main reflector 414 beyond the origin. The axis of symmetry 422 forms an angle of 35° relative to the y-axis. One definition of a parabola is the locus of points in a plane that are equidistant from a directrix (a straight line) and a focus point, with the locus of points being symmetrical about an axis of symmetry. The directrix for the subject parabola would be a straight line perpendicular to the axis of symmetry located 12.5 inches from the vertex 420 and 25 inches from the focal point 418. The portion of the parabola to be rotated about the y-axis extends from the origin 403 to point 416 that has an x-axis value of −4.6 inches. FIG. 4 shows a mirror image parabola on the other side of the y-axis as an aid in visualizing the rotation of the described portion of the parabola perpendicularly about the y-axis. Corresponding reference points that would describe the mirror image parabola are shown. As will be seen in FIG. 2 but is not shown in FIG. 4, a truncated portion of the rotated parabola near the antenna axis, i.e. 0.6 inches along the x-axis, is used to facilitate the passage of the feed horn through the main reflector and to support the mounting brackets 210.

Figure 5:
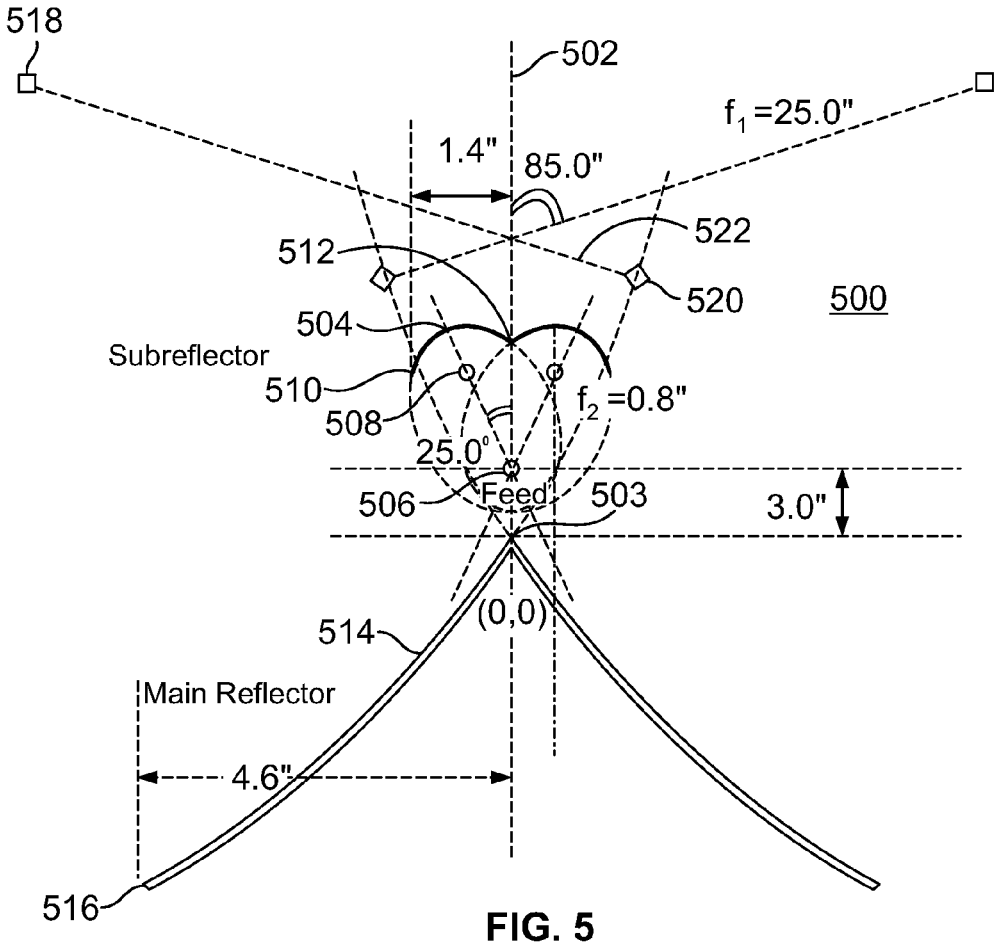
FIG. 5 is a geometric representation of an exemplary antenna in accordance with an embodiment of the present invention with beam peaks at 90° relative to the axis of the antenna.

FIG. 5 shows a geometric representation of a cross-section of another exemplary antenna 500 with beam peaks at 90° relative to the axis 502 of the antenna. The antenna 500 is geometrically similar to the antenna 400 shown in FIG. 4 in that the sub-reflector 504 (corresponding to sub-reflector 404) is formed by the rotation of a portion of an ellipse and a main reflector 514 (corresponding to main reflector 414) is formed by the rotation of a portion of a parabola. The reference numerals in the 500 series used in FIG. 5 corresponds to the reference numerals in the 400 series used in FIG. 4. In view of the similarities, only the different measurements and angles will be described for the antenna 500 of FIG. 5. Focal point 506 is +3.0 inches on the y-axis above the origin 503. Focal point 508 is 0.8 inches from point 506 and forms a major axis that is 25° from the y-axis relative to point 506. The end of the ellipse at point 510 is located −1.4 inches from the y-axis. The distal end of the feed horn is centered about the y-axis and terminates at 506. Thus, the sub-reflector 504 has the same dimensions as sub-reflector 404 with the sub-reflector 504 being located further away from the origin. With regard to the portion of a parabola that defines the main reflector 514, the focus point 518 is located 25 inches from the vertex 520 with the axis of symmetry 522 being at an angle of 85° relative to the y-axis. The directrix for the parabola would be located perpendicular to the axis of symmetry 522 and 25 inches from point 520 and 50 inches from point 518.

Figure 6:
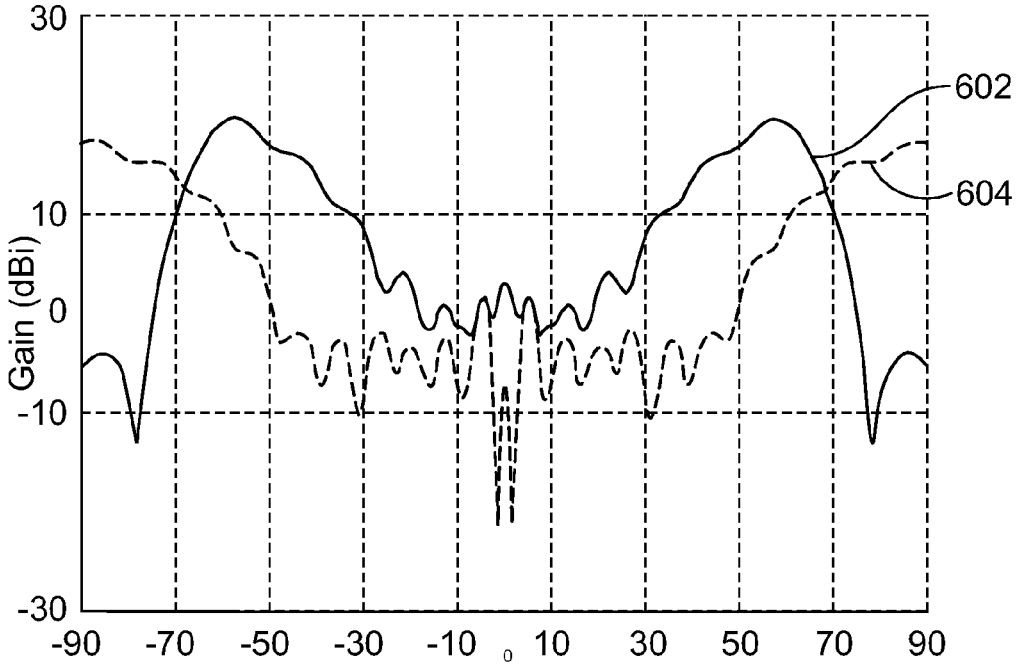
FIG. 6 illustrates antenna gain patterns for the exemplary antennas shown in FIGS. 4 and 5.

FIG. 6 is a graph of antenna gain for the exemplary antennas shown in FIGS. 4 and 5 shown relative to the antenna axis represented by θ=0°. Solid line 602 shows the gain of antenna 400 of FIG. 4 from −90° to +90° with beam peaks occurring at −62.5° and +62.5°. The dashed line 604 shows the gain of antenna 500 of FIG. 5 with beam peaks occurring at −90° and +90°. As mentioned earlier with regard to the geomertical optic ray depiction, it will be seen that the transmission and reception of signals at angles near the antenna axis, i.e. within 30° of θ, is supported. Although not shown in FIG. 6, the gain of antenna 500 at −110° and +110° is still substantial at approximately +5 dBi. Such broad coverage provides an advantage for some applications. For example, where such an antenna is mounted to an aircraft in a generally downward looking orientation and with the aircraft in-flight at a substantial altitude, providing coverage beyond 90° allows communications with satellites that are somewhat above the elevation plane of the aircraft and allows such communications to be maintained during a moderate roll of the aircraft which forces the antenna more than 90° away from the satellite. The illustrated wide coverage beams provide iso-flux patterns within the beam peak designs, i.e. a radiation pattern resulting in constant power density on the ground. The exemplary antenna as described above with regard to 90° beam peaks provides hemispherical coverage and goes beyond that to provide super hemispherical coverage. "Hemispherical coverage" means providing −90° to +90° iso-flux coverage relative to the antenna axis and 360° coverage perpendicular to the antenna axis. "Super hemispherical coverage" means providing −110° to +110° substantial iso-flux coverage relative to the antenna axis and 360° coverage perpendicular to the antenna axis.

Figure 7:
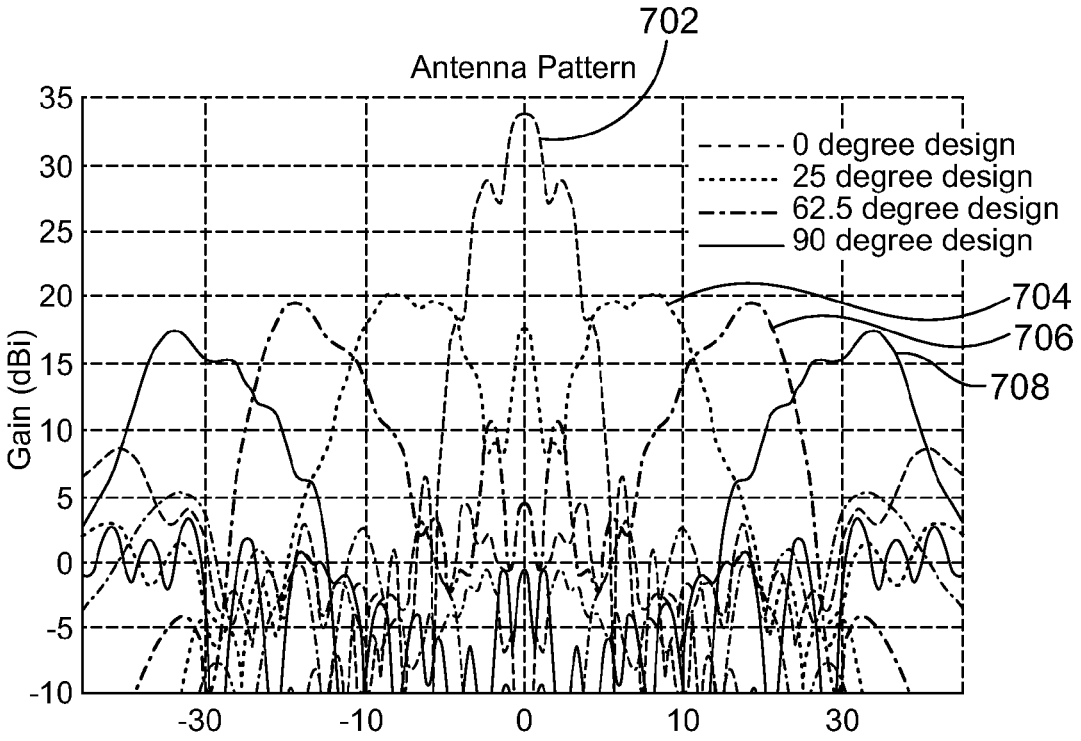
FIGS. 7 and 8 illustrate calculated antenna beam patterns for an exemplary antenna operating at 20.7 GHz and 44.5 GHz, respectively.
Figure 8:
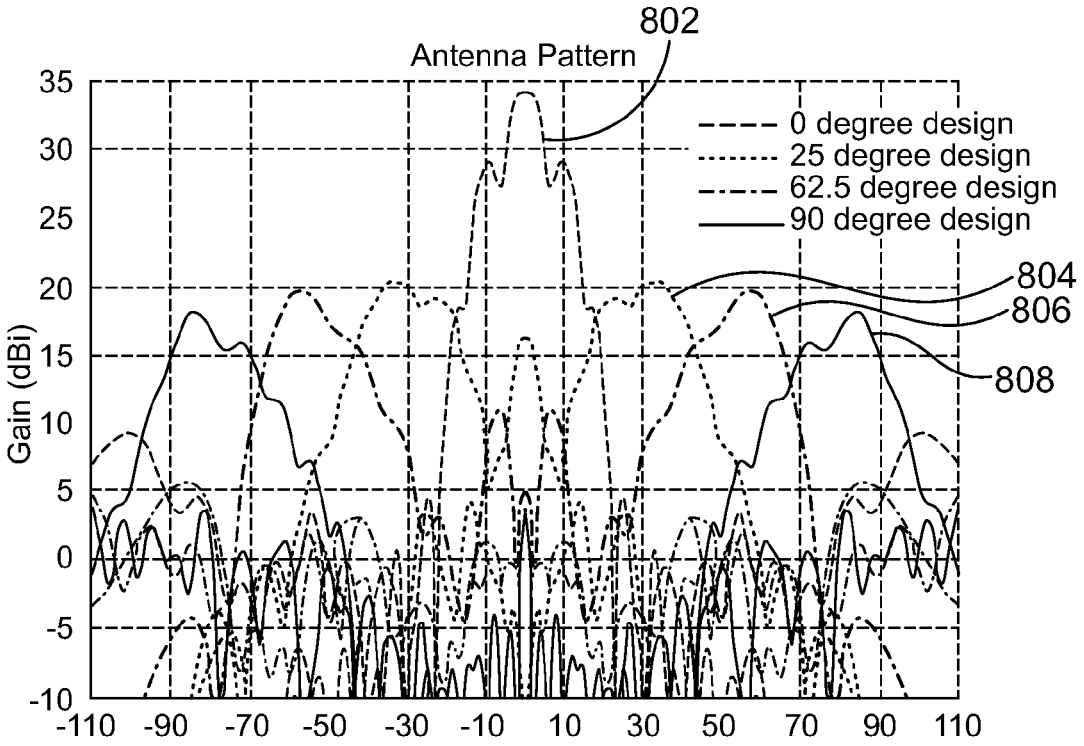

FIGS. 7 and 8 illustrate calculated antenna beam patterns for an exemplary antenna operating at 20.7 GHz and 44.5 GHz, respectively. FIG. 7 shows beam patterns at a frequency of 20.7 GHz. Each of the beam patterns 702, 704, 706 and 708 represent exemplary antennas designed for beam peaks at 0°, 25°, 62.5° and 90°, respectively, with regard to the antenna axis. Exemplary antennas with beam peaks at 0° and 25° are substantially similar to the antennas shown in FIGS. 4 and 5 with the sub-reflector having the same geometry as shown for FIG. 4 but with different distances between the origin and the bottom focus point for the sub-reflector, and with parabola portions corresponding to 414 having different slopes to provide for beam peaks closer to the antenna axis. These differences are shown in the following table.

| Beam Peaks (relative to antenna axis) | Ellipse focus distance to origin (inches) | Parabola focal length (inches) | Parabola θ to antenna axis (degrees) |
|---|---|---|---|
| 0° | 0.5 | 8.5 | 5 |
| 25° | 0.2 | 10.5 | 12 |
| 62.5° | 0.3 | 12.5 | 35 |
| 90° | 3.0 | 25 | 85 |

FIG. 8 shows beam patterns at a frequency of 44.5 GHz. Each of the beam patterns 802, 804, 806 and 808 represent exemplary antennas designed for beam peaks at 0°, 25°, 62.5° and 90°, respectively, with regard to the antenna axis. The beam patterns for FIG. 8 are produced by antennas with the same geometry as explained above with regard to FIG. 7 for the corresponding beam peaks, i.e. 0°, 25°, 62.5° and 90°, respectively. Thus, the same antenna is capable of operation to produce similar beam peaks at both the 20 GHz and 45 GHz bands.

The geometries and dimensions described in the above table can be altered to achieve symmetrical beam peaks anywhere between 0° and 90°. Further, the above described antennas for operation at the 20 GHz and 45 GHz bands also operate effectively at 10 GHz to provide similar beam peaks and iso-flux patterns. The described antenna can thus operate over a bandwidth ratio of 2.25, defined by the highest frequency divided by the lowest frequency, e.g. 45/20; or a bandwidth ratio of 4.5 considering operation at 45 GHz and 10 GHz. Although the antenna itself supports this wide conical beam coverage for such frequencies, it will be understood that the signal transmission feed must also accommodate operation in frequency bands of operation.

The below equations define the geometries for antennas having desired beam peaks.

For the main reflector (parabolid)

$$y-b=\frac{\cos\theta_0(4f_1+2(x-a)\sin\theta_0)\pm\sqrt{\begin{array}{l}\cos^2\theta_0(4f_1+2(x-a)\sin\theta_0)^2-\\ 4\sin^2\theta_0\left(\begin{array}{l}(x-a)^2\cos^2\theta_0-\\ 4f_1(x-a)\sin\theta_0\end{array}\right)\end{array}}}{2\sin^2\theta_0}$$

where $f_1$=12.5", a=1.7, b=0.8, $\theta_0$=35° for 62.5° beam, and $f_1$=25.0", a=1.5, b=1.2, $\theta_0$=85° for 90° beam For the subreflector (ellipsoid)

$$A=\alpha^2\cos^2\theta_1+\beta^2\sin^2\theta_1$$

$$B=2\left(\beta^2\cos\theta_1\sin\theta_1 x-\alpha^2\cos\theta_1\left(\sin\theta_1 x+\sqrt{\beta^2-\alpha^2}\right)\right)$$

$$C=\beta^2\cos^2\theta_1 x^2+\alpha^2\left(\sin\theta_1 x+\sqrt{\beta^2-\alpha^2}\right)^2-\alpha^2\beta^2$$

$$y=\frac{-B\pm\sqrt{B^2-4A\cdot C}}{2A}$$

where α=1.5, β=1.7, θ=25° for both 90° and 62.5° beam.

In the above equations, a represents amount of x directional shift of parabola from the origin, b represents amount of y directional shift of parabola from the origin, $\theta_0$ represents the angle formed by the axis of the parabola relative to the antenna axis, α represents horizontal radius of ellipse, β represents vertical radius of ellipse, and $\theta_1$ represents the angle formed by the major axis of the ellipse relative to the antenna axis.

Figure 9:
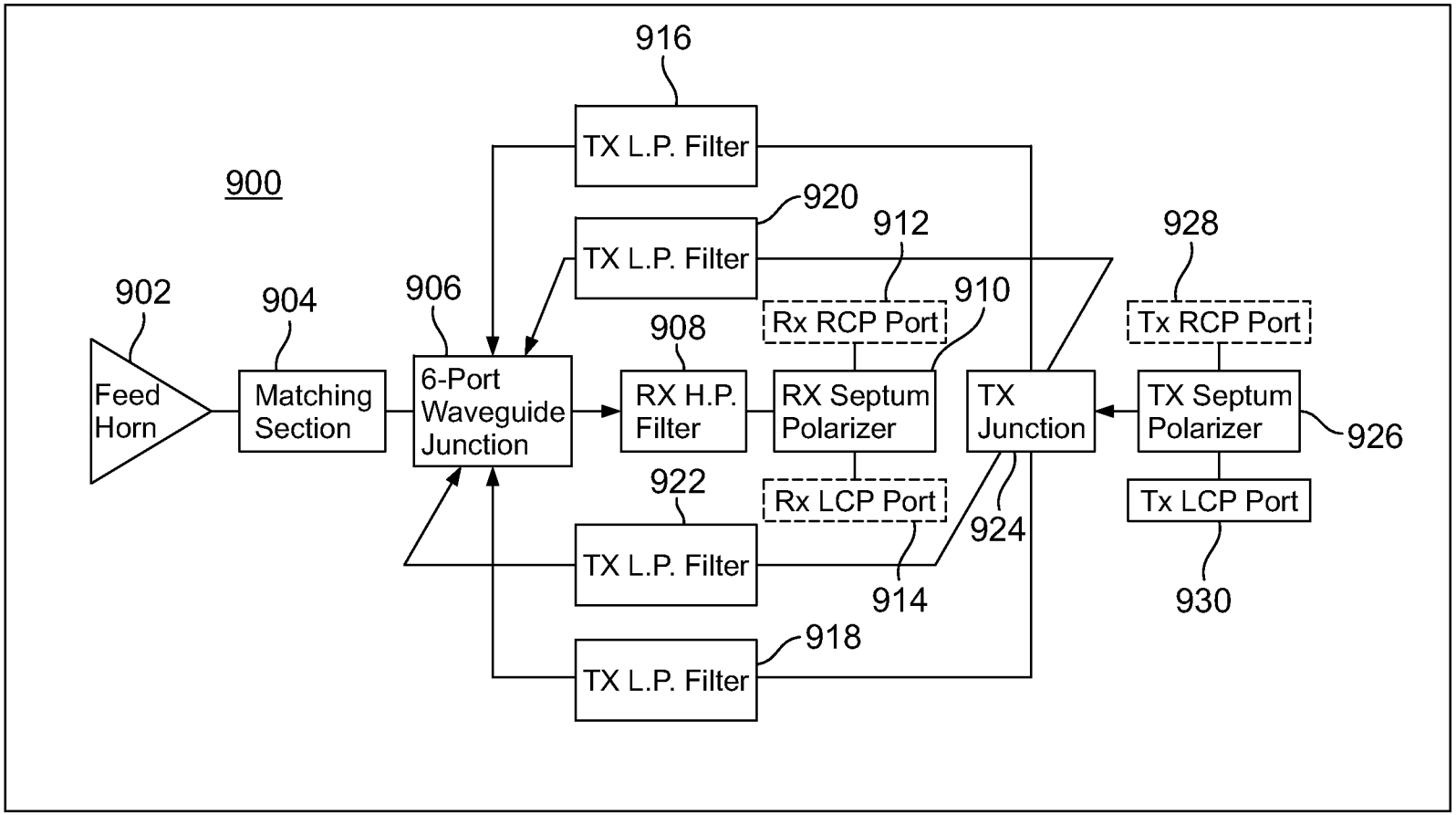
FIG. 9 is a block diagram illustrating an exemplary dual band feed assembly suited for use with an embodiment of the present invention.

FIG. 9 is a block diagram illustrating an exemplary dual band feed assembly 900 suited for use with an antenna embodying the present invention. The exemplary feed assembly 900 supports the transmission of signals in the 20 GHz band and the reception of signals in the 45 GHz band, e.g. to support communications with Advanced Extremely High Frequency (AEHF) satellites. A wide band feed horn 902 may be a multi-flare horn that supports both bands with high-efficiency and optimized radiation. A matching section 904 between the horn 902 and a 6-port waveguide junction 906 is used to optimize return loss performance. Typically the feed network uses a smaller circular waveguide and the horn utilizes a larger circular waveguide hence requiring the matching section 904 to match the impedances.

In general, the feed network to the right of the matching section 904 separates the 20 GHz transmit band and 45 GHz receive band with sufficient isolation, preferably more than 60 dB, and converts between linear polarization and circular polarization. The waveguide junction 906 has six ports: one common port connected to the matching section 904; one port to couple 45 GHz signals to the receiver high pass filter 908; and four ports coupled to accept 20 GHz transmit signals from low pass filters 916, 918, 920, 922. The receiver high pass filter 908 may comprise a smaller cross-section waveguide which passes the high-frequency 45 GHz signals and cuts-off the low-frequency 20 GHz signals. By selecting the length of the smaller waveguide used for filter 908, the 20 GHz signals can be isolated by 60 dB or more. The received septum polarizer 910 converts the linearly polarized signals into two circular polarized orthogonal signals (LHCP and RHCP) that are delivered respectively to the receiver right circular polarized port 912 and the receiver left circular polarized port 914. If only a single sense of circular polarization is to be utilized, one of these ports could be terminated to RF load which could be internal to the polarizer 910. Appropriate signal decoding equipment can be coupled to ports 912 and 914 to recover information encoded on the signals.

The four ports of waveguide junction 906 coupled to the transmit low pass filters are 90° apart circumferentially. These ports are designed to allow the passage of 20 GHz transmit signals while rejecting 45 GHz receive signals, preferably by 60 dB or more. Transmit filters 916, 918 are disposed at ports of the transmit junction 924 that are 0° and 180°, or at 90° and 270°, while the other transmit filters 920, 922 are disposed at the other orthogonal set of ports of the transmit junction 924 (These ports may be also be alternatively connected through an H-plane tee that can be combined with a short-slot 90° hybrid coupler which combines two orthogonal linear polarized signals with equal amplitude and with 90° phase quadrature to generate circular polarized signals). Transmit septum polarizer 926 accepts right circular polarized signals at port 928 and left circular polarized signals at port 930 and couples the signals to the four orthogonal ports of the transmit junction 924. Preferably, all of the feed assembly uses waveguide components in order to minimize insertion loss.

The feed assembly described above is merely representative of one dual band implementation. The exemplary antenna in accordance with the present invention is most effective with an evenly distributed conically feed but is not dependent on a particular feed assembly. The antenna also effectively supports communications in the 20 GHz/30 GHz bands associated with communications with a Wideband Global SATCOM (WGS) satellite. Alternatively, the antenna is capable of supporting communications in the 20 GHz/30 GHz/45 GHz bands with a feed assembly that likewise supports such communications. Reference can be made to U.S. Pat. No. 7,737,904, "ANTENNA SYSTEMS FOR MULTIPLE FREQUENCY BANDS" for additional information about horn antenna design that supports multiple frequency bands of operation; this document is incorporated herein by reference.

Although exemplary implementations of the invention have been depicted and described, it will be apparent to those skilled in the art that various modifications, additions, substitutions, and the like can be made without departing from the spirit of the invention.

The scope of the invention is defined in the following claims.

We claim:

1. An antenna for transmitting and receiving radio frequency signals comprising:

a sub-reflector being an ellipsoid defined by a portion of an ellipse having a major axis not parallel to an axis of the antenna, the portion of the ellipse being in a plane that includes the axis of the antenna, where the portion of the ellipse is rotated perpendicularly about the axis of the antenna to define a first reflecting surface of the sub-reflector, a center of the sub-reflector being on the axis of the antenna with the first reflecting surface facing and cooperating with a signal feed system consisting of a signal horn centered at the axis of the antenna so that radio waves from a distal end of the feed system impinge on the first reflecting surface and signals received by the antenna are reflected from the first reflecting surface to the distal end of the feed system; and a main reflector defined by a portion of a parabola being in a plane that includes the axis of the antenna, where the portion of the parabola is rotated perpendicularly about the axis of the antenna to form a second reflecting surface, the main reflector having a center being on the axis of the antenna with the second reflecting surface facing the first reflecting surface of the sub-reflector so that radio waves reflected from the first reflecting surface strike the second reflecting surface which in turn reflects the radio waves to form radio waves transmitted from the antenna, radio waves received by the antenna strike the second reflecting surface of the main reflector and are reflected to the first reflecting surface which in turn reflects the radio waves to the distal end of the feed system;

the antenna not comprising a phase shifter, the antenna producing a signal pattern of a wide coverage conical beam with a selectable beam peak between 45 degrees and 90 degrees relative to the antenna axis.

2. The antenna of claim 1 wherein the wide coverage conical beam is substantially an iso-flux pattern.

3. The antenna of claim 2 wherein the selected beam peak is maintained over at least a 2.25-to-1 bandwidth ratio at Gigahertz frequencies.

4. The antenna of claim 2 wherein the selected beam peak is maintained over at least a 4.5-to-1 bandwidth ratio at Gigahertz frequencies.

5. The antenna of claim 2 wherein the selected beam peak is maintained for all frequencies between 20 Gigahertz and 45 Gigahertz without any changes to the sub-reflector and main reflector.

6. The antenna of claim 1 wherein first parameters define the portion of the parabola and hence the second reflecting surface of the main reflector, and a first distance is between the center of the main reflector and the distal end of the feed system, the values of the first parameters together with the value of the first distance determining a corresponding beam peak of the antenna while the first reflecting surface of the sub-reflector remains unchanged.

7. The antenna of claim 1 further comprising brackets fixed to the main reflector to mount the antenna to a supporting structure so that a distal edge of the main reflector is held a sufficient distance away from the supporting structure to allow a beam peak of at least 110 degrees to be transmitted from and/or received by the main reflector without interference from the supporting structure.

8. The antenna of claim 1 wherein the ellipse has one focus point on the axis of the antenna and the other focus point about 0.8 inches from the one focus point, a major axis of the ellipse having at an angle of about 25 degrees relative to the axis of the antenna, the portion of the ellipse to be rotated perpendicularly about the axis of the antenna extending from an intersection of the ellipse and the axis of the antenna to a distance about 1.4 inches perpendicular to the axis of the antenna.

9. The antenna of claim 1 wherein a section of the main reflector adjacent the center of the main reflector is truncated to form a plane substantially perpendicular to the axis of the antenna, the section defining an opening through which at least a portion of the feed system passes so that the distal end of the feed system is between the sub-reflector and the section.

10. In an antenna system having a signal feed system consisting of a signal horn that has a distal end centered at an axis of an antenna, radio waves to be transmitted are emitted from the distal end of the signal feed system to the antenna and radio waves to be received are reflected from the antenna to the distal end of the signal feed system, the antenna comprising:

a sub-reflector being an ellipsoid defined by a portion of an ellipse having a major axis not parallel to an axis of the antenna, the portion of the ellipse being in a plane that includes the axis of the antenna, where the portion of the ellipse is rotated perpendicularly about the axis of the antenna to define a first reflecting surface of the sub-reflector, a center of the sub-reflector being on the axis of the antenna with the first reflecting surface facing the distal end of the signal feed system so that radio waves from a distal end of the feed system impinge on the first reflecting surface and signals received by the antenna are reflected from the first reflecting surface to the distal end of the feed system; and a main reflector defined by a portion of a parabola being in a plane that includes the axis of the antenna, where the portion of the parabola is rotated perpendicularly about the axis of the antenna to form a second reflecting surface, the main reflector having a center being on the axis of the antenna with the second reflecting surface facing the first reflecting surface of the sub-reflector so that radio waves reflected from the first reflecting surface strike the second reflecting surface which in turn reflects the radio waves to form radio waves to be transmitted, radio waves received by the antenna strike the second reflecting surface of the main reflector and are reflected to the first reflecting surface which in turn reflects the radio waves to the distal end of the feed system;

the sub-reflector and main reflector producing a signal pattern of a wide coverage conical beam with a selectable beam peak between 45 degrees and 90 degrees relative to the antenna axis, the antenna system not comprising a phase shifter.

11. The antenna of claim 10 wherein the wide coverage conical beam is substantially an iso-flux pattern.

12. The antenna of claim 11 wherein the selected beam peak is maintained over at least a 2.25-to-1 bandwidth ratio at Gigahertz frequencies.

13. The antenna of claim 11 wherein the selected beam peak is maintained over at least a 4.5-to-1 bandwidth ratio at Gigahertz frequencies.

14. The antenna of claim 11 wherein the selected beam peak is maintained for all frequencies between 20 Gigahertz and 45 Gigahertz without any changes to the sub-reflector and main reflector.

15. The antenna of claim 10 wherein first parameters define the portion of the parabola and hence the second reflecting surface of the main reflector, and a first distance is between the center of the main reflector and the distal end of the feed system, the values of the first parameters together with the value of the first distance determining a corresponding beam peak of the antenna while the first reflecting surface of the sub-reflector remains unchanged.

16. The antenna of claim 10 further comprising brackets fixed to the main reflector to mount the antenna to a supporting structure so that a distal edge of the main reflector is held a sufficient distance away from the supporting structure to allow a beam peak of at least 110 degrees to be transmitted from or received by the main reflector without interference from the supporting structure.

17. The antenna of claim 10 wherein the ellipse has one focus point on the axis of the antenna and the other focus point about 0.8 inches from the one focus point, a major axis of the ellipse having at an angle of about 25 degrees relative to the axis of the antenna, the portion of the ellipse to be rotated perpendicularly about the axis of the antenna extending from an intersection of the ellipse and the axis of the antenna to a distance about 1.4 inches perpendicular to the axis of the antenna.

18. The antenna of claim 10 wherein a section of the main reflector adjacent the center of the main reflector is truncated to form a plane substantially perpendicular to the axis of the antenna, the section defining an opening through which at least a portion of the feed system passes so that the distal end of the feed system is between the sub-reflector and the section.

19. The antenna of claim 10 wherein a multi-band feed assembly is used in conjunction with the sub-reflector and main reflector pair for transmission and reception of radio frequency signals with one or more geostationary satellites and with one or more ground terminals.

* * * * *